US006662691B2

(12) United States Patent
Yu

(10) Patent No.: US 6,662,691 B2
(45) Date of Patent: Dec. 16, 2003

(54) ARRESTING DEVICE OF PLIERS

(76) Inventor: Hong-Chow Yu, No. 28, Lane 157, Yong Hsin Rd., Ta Li City, Taichung Hsien (TW)

( * ) Notice: Subject to any disclaimer, the term of this patent is extended or adjusted under 35 U.S.C. 154(b) by 0 days.

(21) Appl. No.: 10/138,449

(22) Filed: May 2, 2002

(65) Prior Publication Data

US 2003/0029281 A1 Feb. 13, 2003

(51) Int. Cl.[7] ..... B25B 7/04
(52) U.S. Cl. ..... 81/385; 81/358; 81/413
(58) Field of Search ..... 81/385, 411, 413, 81/412, 405, 407, 341, 358

(56) References Cited

U.S. PATENT DOCUMENTS 2,777,347 A * 1/1957 Sendoykas ..... 81/379
6,101,908 A * 8/2000 Azkona ..... 81/385
6,467,380 B1 * 10/2002 Azkona ..... 81/413

* cited by examiner

*Primary Examiner*—Lee D. Wilson
(74) *Attorney, Agent, or Firm*—W. Wayne Liauh

(57) ABSTRACT

An arresting device is pivotally mounted between two handles of a pair of pliers. The arresting device comprises a sleeve and a rod fitted into the sleeve. The sleeve and the rod are pivotally fastened at one end with the two handles. The sleeve has a receiving cell, a retaining piece disposed in the receiving cell, and a spring disposed between the retaining piece and a side wall of the receiving cell. The retaining piece is urged by the spring to retain the rod. The receiving cell is provided with a pin pivoted thereto such that the pin is corresponding in location to the movable end of the retaining piece, and that the pin can push away the retaining piece from the rod. As the pin is turned such that a recess of the pin is corresponding in location to the retaining piece, the movable end of the retaining piece is in the free state, thereby enabling the retaining piece to be urged by the spring to retain the rod.

5 Claims, 12 Drawing Sheets

ARRESTING DEVICE OF PLIERS

FIELD OF THE INVENTION

The present invention relates generally to a pair of pliers, and more particularly to an arresting device which is mounted between two handles of the plies for checking motion of the two handles.

BACKGROUND OF THE INVENTION

As shown in FIGS. 11 and 12, a pair of pliers 8 of the prior art comprises two handles 81 and 82, between which an arresting device 9 and a recovery spring 83 are mounted. The arresting device 9 comprises a sleeve 91 and a rod 92 fitted into the sleeve 91. The sleeve 91 is pivotally fastened at one end with the first handle 81, whereas the rod 92 is pivotally fastened at one end with the second handle 82 such that other end of the rod 92 is fitted into other end of the sleeve 91 in conjunction with a spring 94 which is fitted over the other end of the rod 92. The other end of the sleeve 91 is provided with a projection 911 extending therefrom for pivoting one end of a retaining member 93. The retaining member 93 has a hole 931 with a hole diameter slightly greater than the outer diameter of the rod 93. The retaining member 93 is provided with a control lever 932 extending therefrom. The spring 94 is located between the other end of the sleeve 91 and the retaining member 93. The retaining member 93 is urged by the spring 94 to tilt such that the hole 931 of the retaining member 93 is fitted slantingly over the rod 92. As the rod 92 is pushed into the sleeve 91, the retaining member 93 is pushed away to enable the rod 92 to enter the sleeve 91. In the meantime, the rod 92 is located by the retaining member 93 to prevent the rod 92 from being drawn out of the sleeve 91. As a result, the two handles 81 and 82 of the pliers 8 can not be moved away from each other, so as to allow two jaws of the pliers 8 to remain in the state of holding a workpiece. The two handles 81 and 82 are set free by pressing the control lever 932 of the retaining member 93 to bring about the disengagement of the retaining member 93 with the rod 92. The two handles 81 and 82 are thus forced by the spring 83 to move away from each other.

Such a prior art arresting device 9 as described above is limited in function in that it is capable of locating the handles of the pliers 8 in a unidirectional manner. As a result, the prior art pliers 8 can not be used to work on a variety of workpieces.

SUMMARY OF THE INVENTION

The primary objective of the present invention is to provide a pair of pliers with an arresting device which is free of the deficiency of the prior art arresting device described above.

In keeping with the principle of the present invention, the foregoing objective of the present invention is attained by an arresting device which is disposed between two handles of a pair of pliers and is formed of a sleeve and a rod. The sleeve is pivotally fastened at one end with a first handle of the pliers, whereas the rod is pivotally fastened at one end with a second handle of the pliers. The sleeve is provided at other end with a receiving cell and a retaining piece which is disposed in the receiving cell such that one end of the retaining piece prsses against a projection of the receiving cell. The retaining piece has a movable end and a through hole with a hole diameter greater than an outer diameter of the rod. A spring is disposed between the retaining piece and one side wall of the receiving cell such that one end of the spring urged the retaining piece to enable the movable end of the retaining piece to sway so as to cause the through hole of the retaining piece to retain slantingly the rod. The receiving cell is provided with a pin corresponding in location to the movable end of the retaining piece. The pin is turned to cause the retaining piece to release the rod, thereby enabling the rod to move in two directions. The pin is provided at one end with a recess, and at other end with a control lever. As the control lever is turned such that the recess of the pin is corresponding in location to the retaining piece, the movable end of the retaining piece is in the free state, thereby enabling the retaining piece to be pushed by the spring force of the spring to retain the rod in such a manner that the retaining piece restricts unidirectionally the movement direction of the rod.

The features and the advantages of the present invention will be more readily understood upon a thoughtful deliberation of the following detailed description of two preferred embodiments of the present invention with reference to the accompanying drawings.

DETAILED DESCRIPTION OF THE PREFERRED EMBODIMENTS

Figure 1:
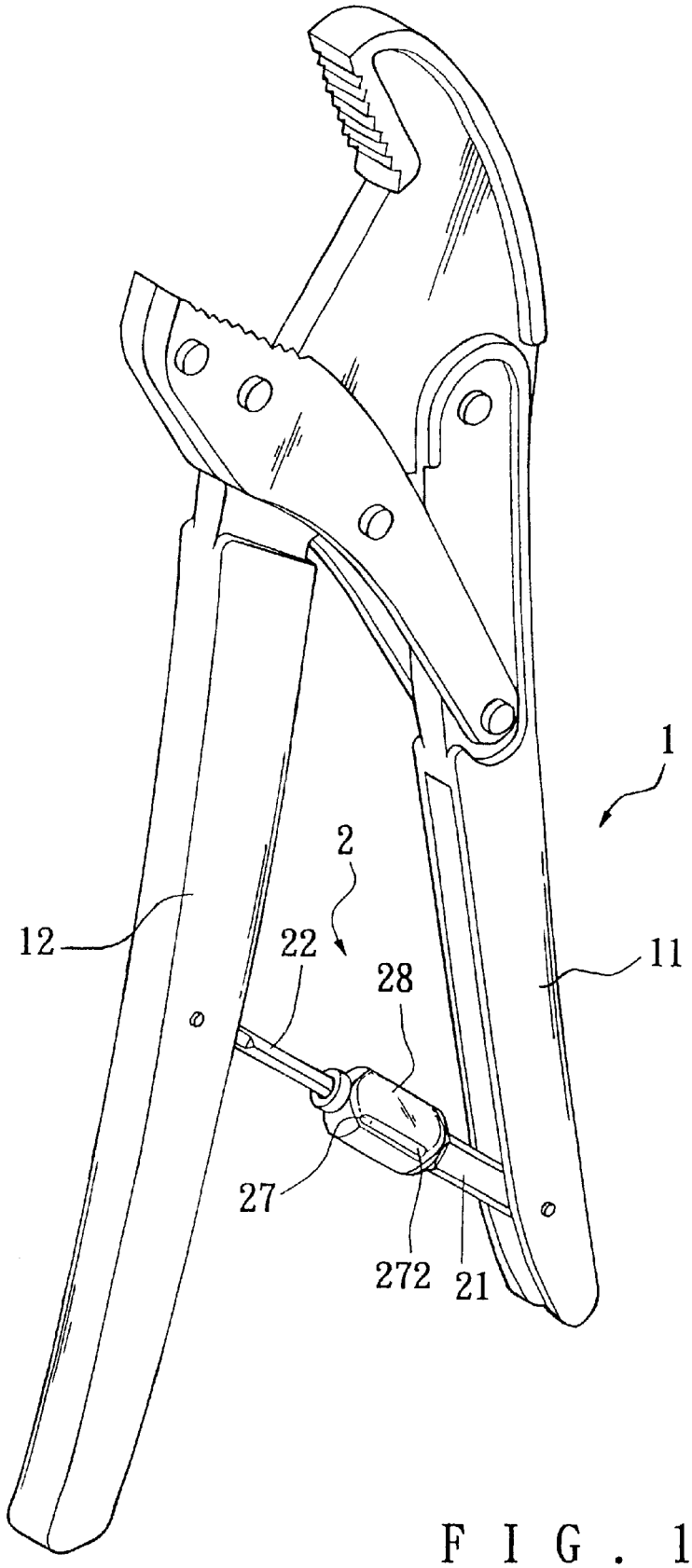
FIG. 1 shows a perspective view of a first preferred embodiment of the present invention.
Figure 2:
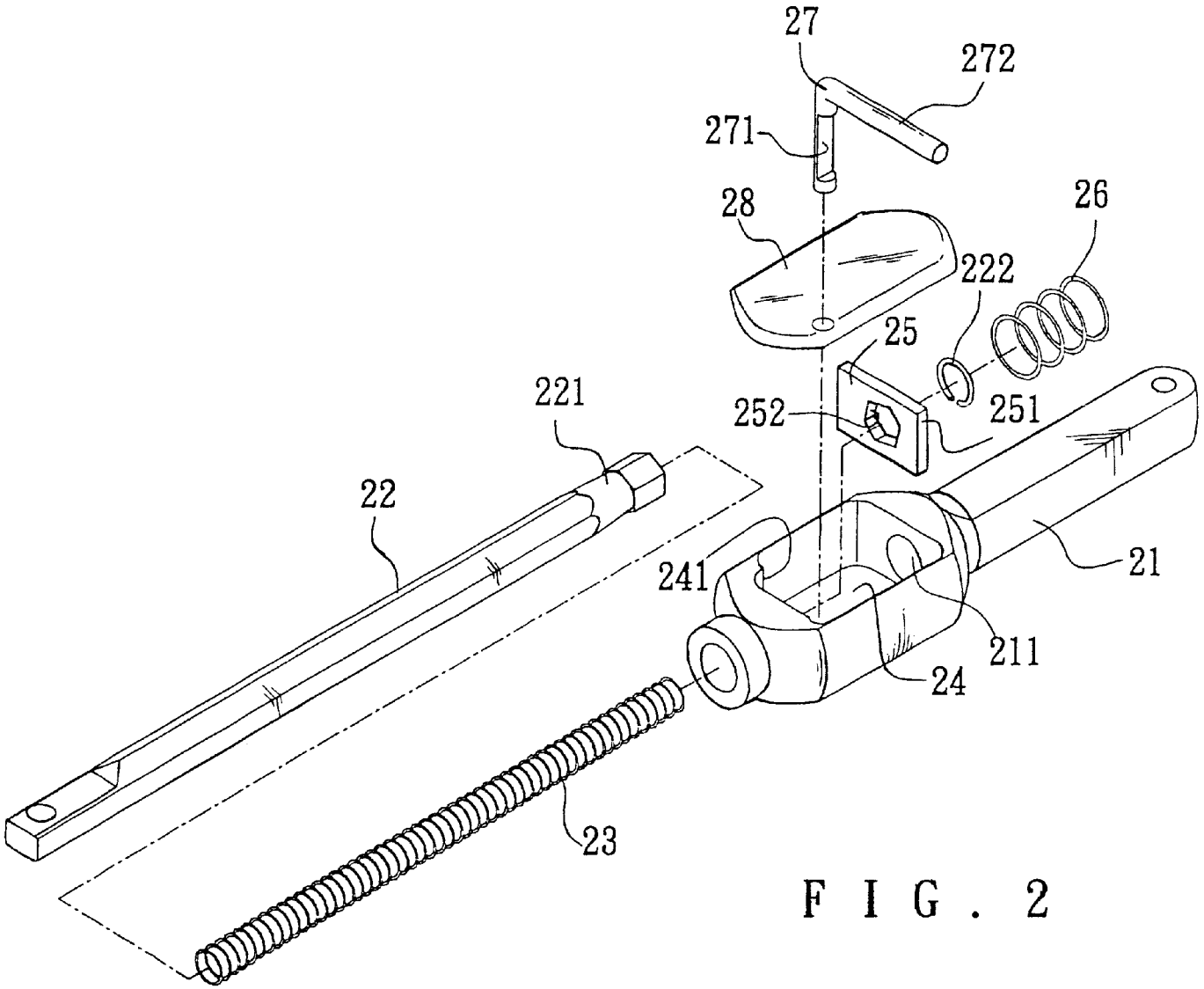
FIG. 2 shows an exploded view of the first preferred embodiment of the present invention.
Figure 3:
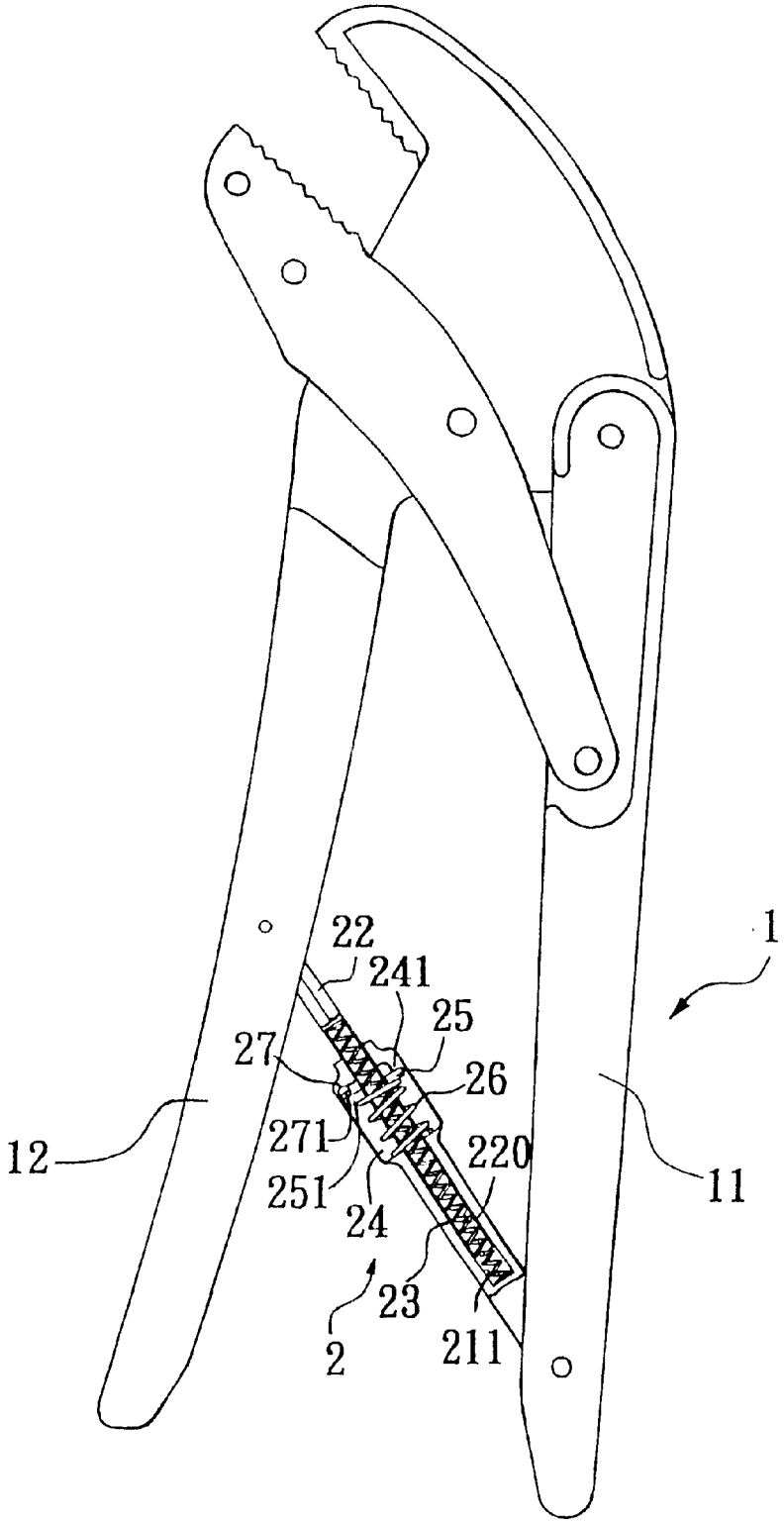
FIG. 3 shows a longitudinal sectional view of the first preferred embodiment of the present invention in combination.

As shown in FIGS. 1–7, an arresting device 2 embodied in the present invention is mounted between a first handle 11 and a second handle 12 of a pair of pliers 1. The arresting device 2 comprises a sleeve 21 and a rod 22. The sleeve 21 is pivotally fastened at one end with the first handle 11, while the rod 22 is pivotally fastened at one end with the second handle 12. The sleeve 21 has an axial hole 211 which is dimensioned to receive the rod 22 via a receiving cell 24 located at other end of the sleeve 21. The rod 22 is provided at other end with a receiving hole 220. Located between the bottom 212 of the axial hole 211 and the receiving hole 220 of the rod 22 is a first spring 23, which urges the rod 22 to jut out of the sleeve 21. The rod 22 is further provided at other end with a small diametrical segment 221 and a retaining ring 222 fitted over the small diametrical segment 221. The retaining ring 222 is slightly greater in outer diameter than the rod 22.

The receiving cell 24 of the sleeve 21 is provided with a cover 28, and a retaining piece 25 which is located in the receiving cell 24 such that one end of the retaining piece 25 presses against a projection 241 of the receiving cell 24, and that the retaining piece 25 is contiguous to other end of the sleeve 21. The retaining piece 25 has a movable end 251 which is located at other end of the retaining piece 25. The retaining piece 25 is provided with a through hole 252 greater in diameter than the rod 22. Located between the retaining piece 25 and one side wall 242 of the receiving cell 24 is a second spring 26, which urges the retaining piece 25 such that the movable end 251 of the retaining piece 25 sways in the direction toward the rod 22, thereby enabling the through hole 252 to retain slantingly the rod 22 which is thus capable of moving inwards only.

The receiving cell 24 is provided with a pin 27 corresponding in location to the movable end 251 of the retaining piece 25. The pin 27 is capable of pushing the retaining piece 25 away from the rod 22, so as to enable the rod 22 to move freely in two directions. The pin 27 is movably disposed in the receiving cell 24 such that a control lever 272 of the pin 27 is jutted out of the receiving cell 24. The pin 27 is provided with a recess 271 corresponding in location to the retaining piece 25. When the pin 27 is so turned that the recess 271 is opposite to the retaining piece 25, the movable end 251 of the retaining piece 25 is in the free state. As the retaining piece 25 is pushed by the spring force of the second spring 26, the through hole 252 of the retaining piece 25 retains slantingly the rod 22 such that the rod 22 can move inwards only.

Figure 4:
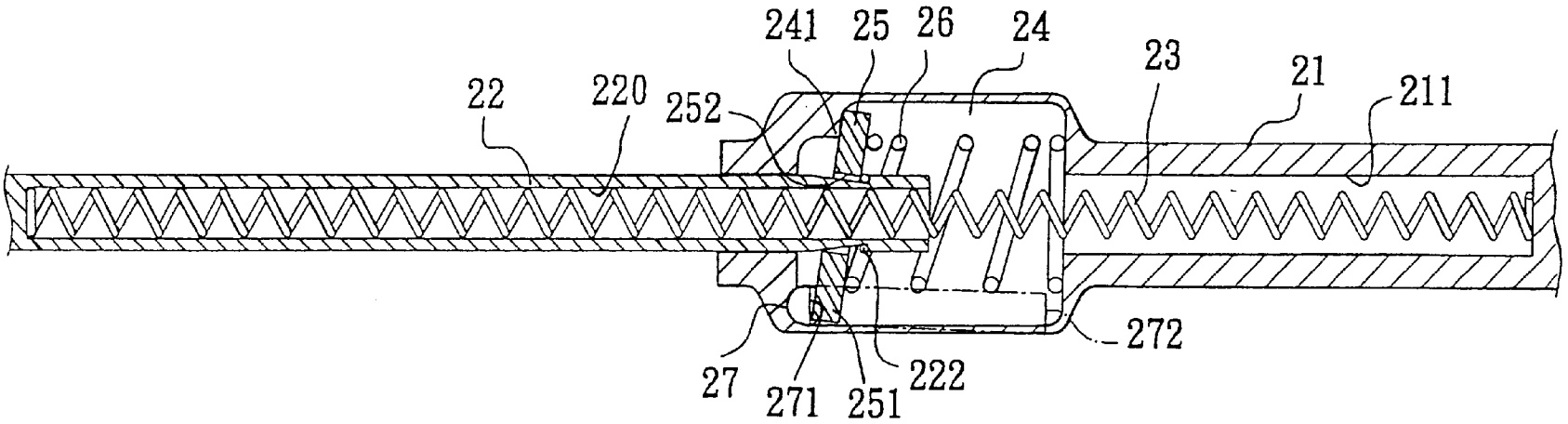
FIG. 4 shows a longitudinal sectional view of the first preferred embodiment of the present invention in action.
Figure 5:
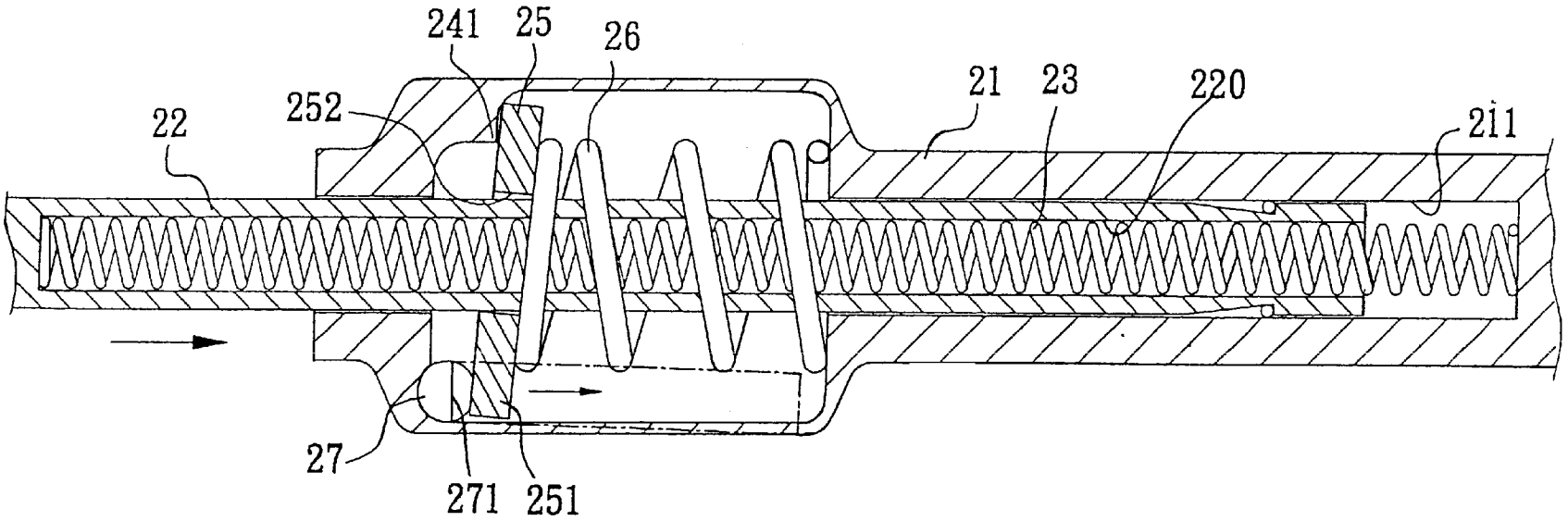
FIG. 5 shows another longitudinal sectional view of the first preferred embodiment of the present invention in action.

When the pliers 1 are used the hold a workpiece, the pin 27 is first turned such that the recess 271 of the pin 27 is corresponding in location to the retaining piece 25, thereby enabling the movable end 251 of the retaining piece 25 to be in the free state, as shown in FIG. 4. In the meantime, the retaining piece 25 is urged by the second spring 26 to sway such that the rod 22 is retained by the through hole 252 of the retaining piece 25. When the two handles 11 and 12 are held firmly, the rod 22 is pushed to slide into the sleeve 21. When the rod 22 slides, the movable end 251 of the retaining piece 25 is actuated to move backwards. As a result, the rod 22 is no longer retained by the through hole 252 of the retaining piece 25, as shown in FIG. 5. The rod 22 can be moved into the axial hole 211 of the sleeve 21. When the two handles 11 and 12 are no longer held firmly, the retaining piece 25 is urged by the second spring 26 to move back to the state as shown in FIG. 4, so as to locate the rod 22. As a result, the two handles 11 and 12 are located.

Figure 6:
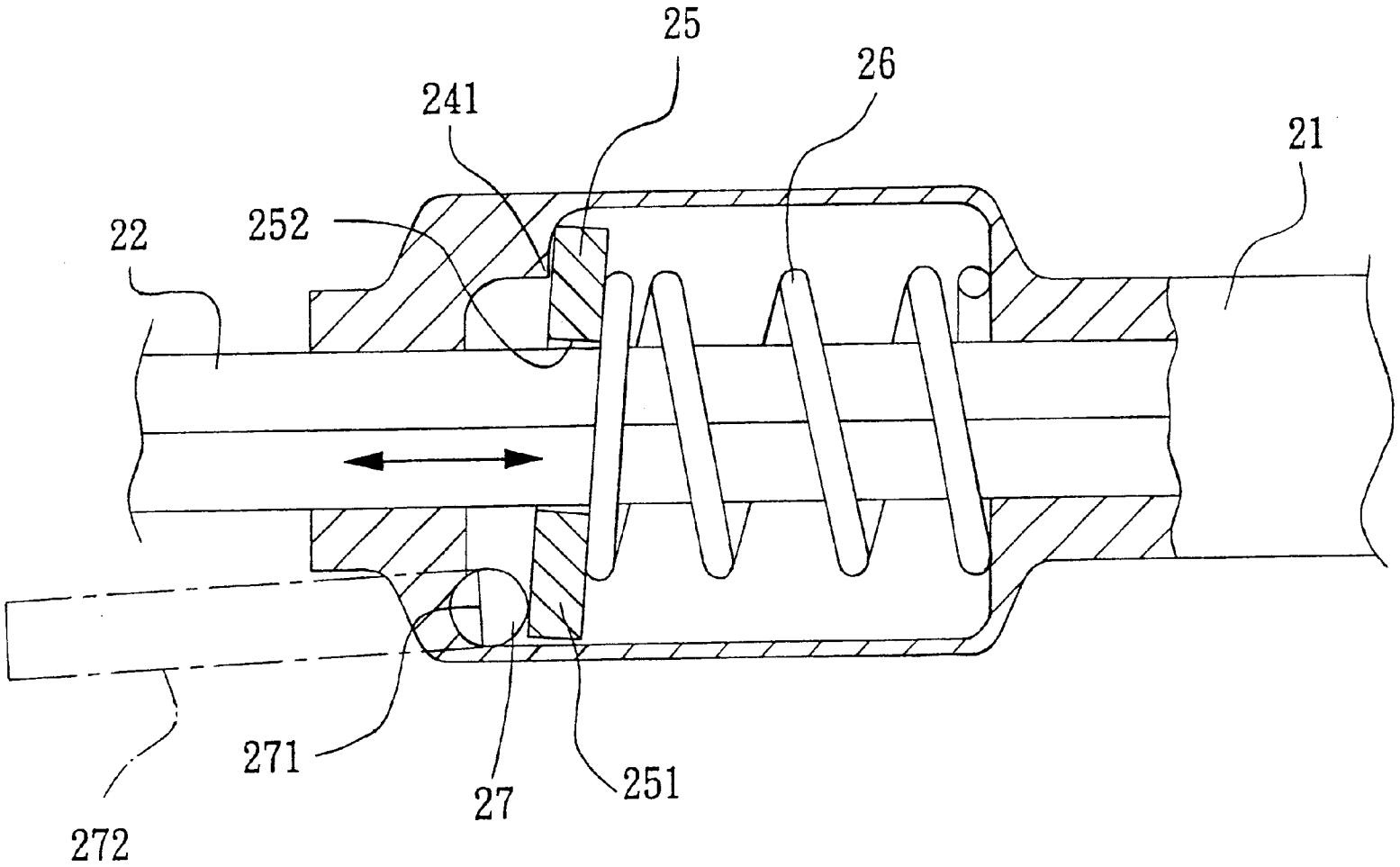
FIG. 6 shows another longitudinal sectional view of the first preferred embodiment of the present invention in action.
Figure 7:
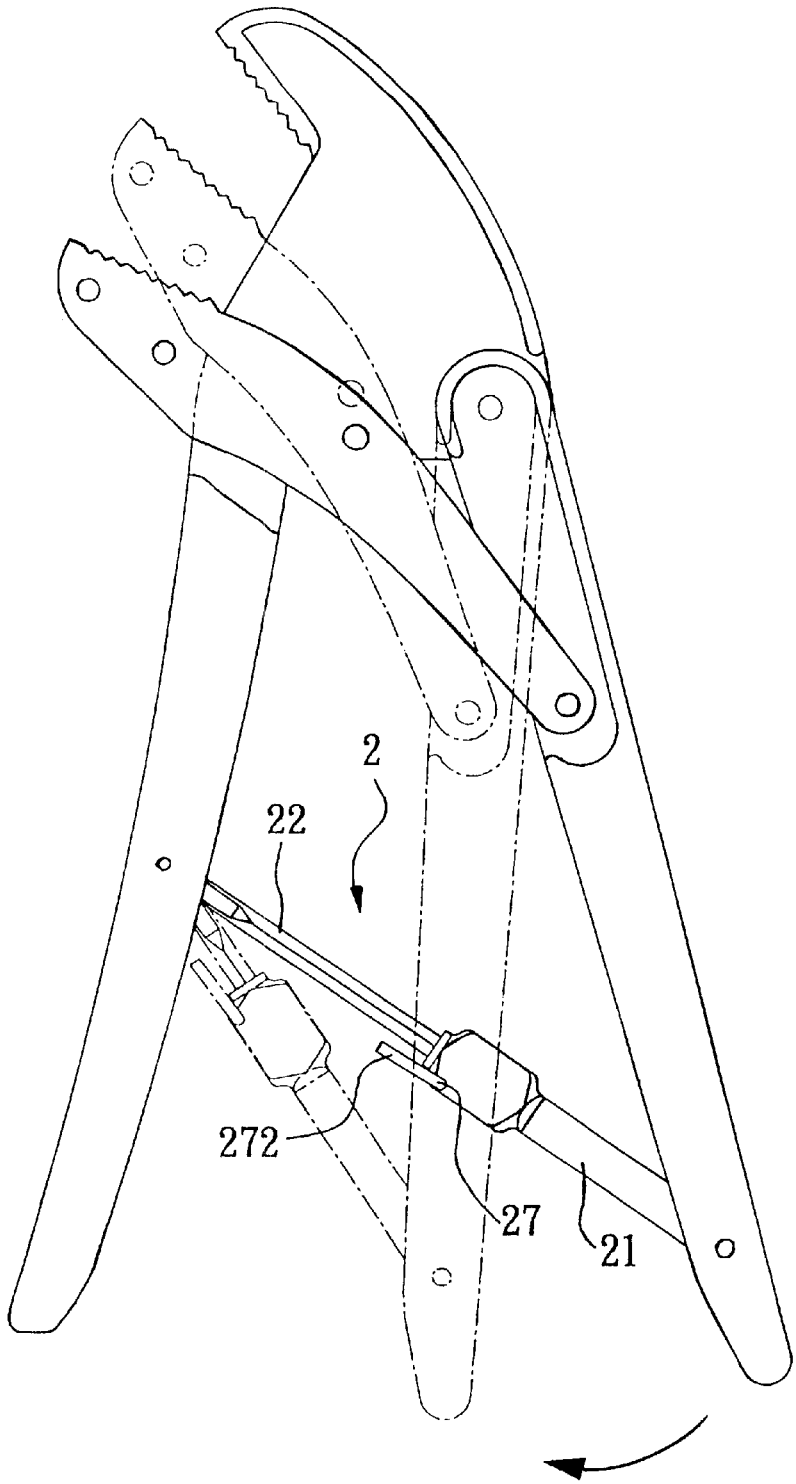
FIG. 7 shows a schematic view of the first preferred embodiment of the present invention at work.

The pliers 1 can be freely set to facilitate the holding of any workpiece by turning the control lever 272 of the pin 27, thereby causing the pin 27 to push the movable end 251 of the retaining piece 25 so as to prevent the rod 22 from being retained by the through hole 252 of the retaining piece 25, as shown in FIG. 6. The rod 22 is thus in the free state to enable the two handles 11 and 12 of the pliers 1 to move toward or away from each other to hold a workpiece, as shown in FIG. 7. The first spring 23 is at work to urge the rod 22 and the sleeve 21 so as to cause the two handles 11 and 12 to return to their original positions. As a result, the pliers 1 of the present invention is devoid of a recovery spring which is provided in the prior art pliers. The retaining ring 222 of the rod 22 serves to prevent the rod 22 from slipping out of the sleeve 21 by being retained in the through hole 252 of the retaining piece 25 at the time when the rod 22 is in motion.

The arresting device 2 is characterized by the movable end 251 of the retaining piece 25, and the pin 27 which is pivoted to the receiving cell 24 to push away the retaining piece 25 so that the rod 22 is not retained by the retaining piece 25. When the pin 27 is so turned that the recess 271 of the pin 27 is corresponding in location to the retaining piece 25, the movable end 251 of the retaining piece 25 is in the free state, thereby enabling the second spring 26 to urge the retaining piece 25 to retain the rod 22. The present invention is provided with the first spring 23, which is located between the sleeve 21 and the rod 22 to enable the two handles 11 and 12 of the pliers 1 to return to their original positions.

Figure 8:
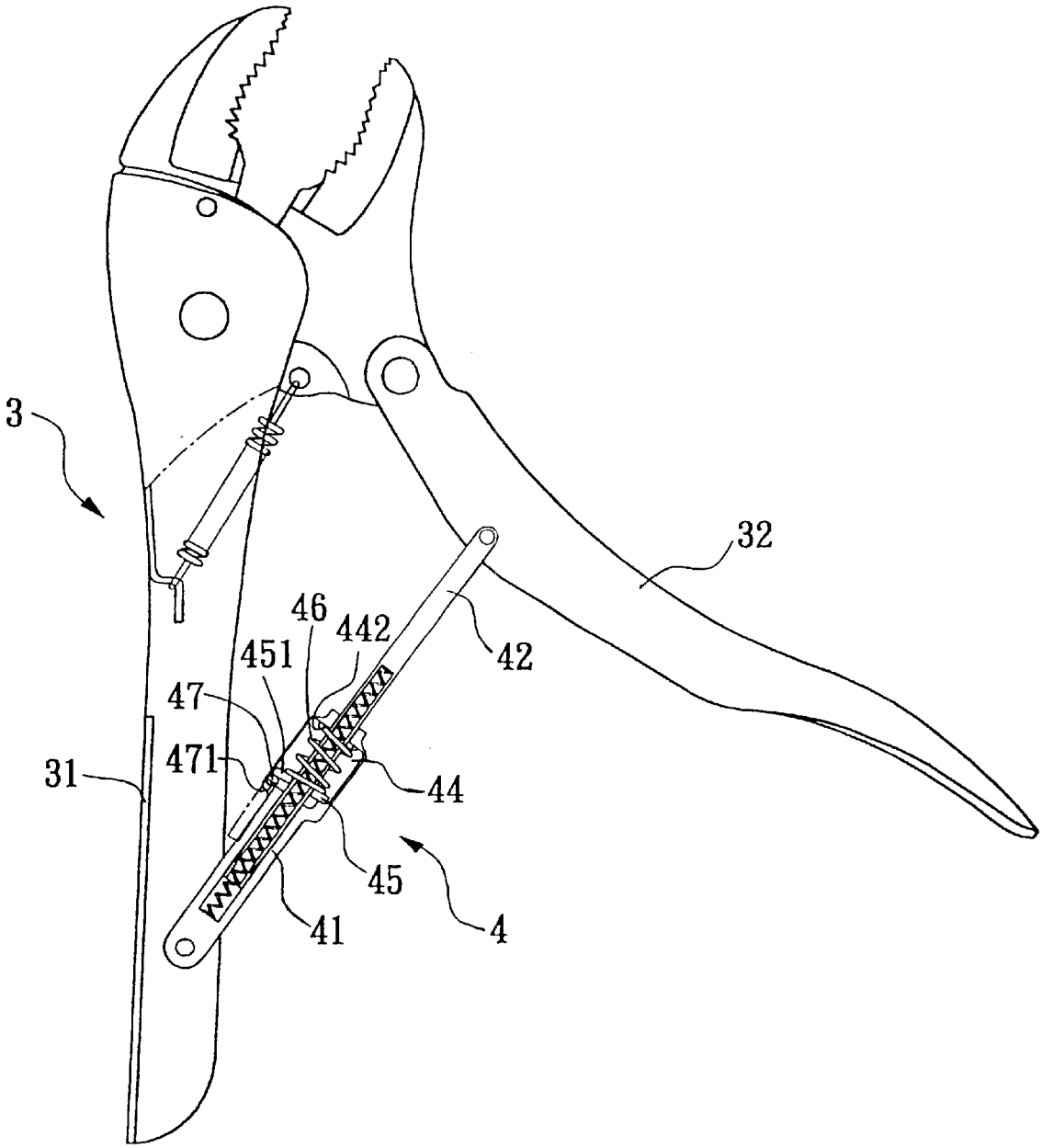
FIG. 8 shows a longitudinal sectional view of a second preferred embodiment of the present invention.
Figure 9:
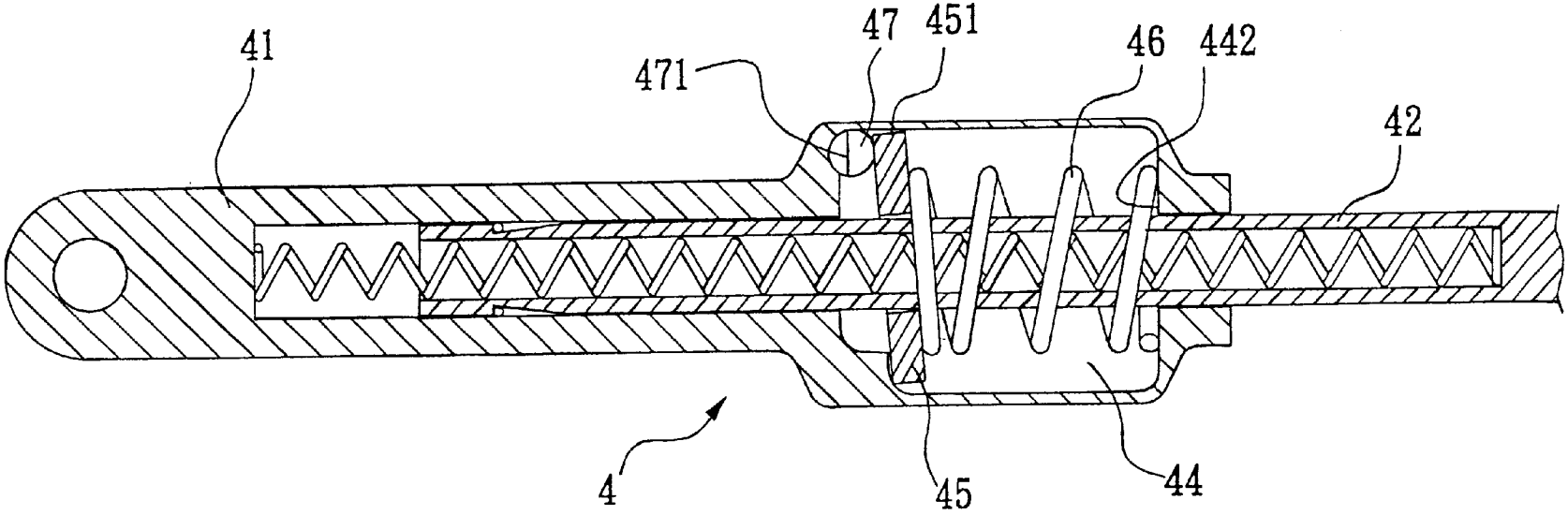
FIG. 9 shows an enlarged sectional view of the second preferred embodiment of the present invention.
Figure 10:
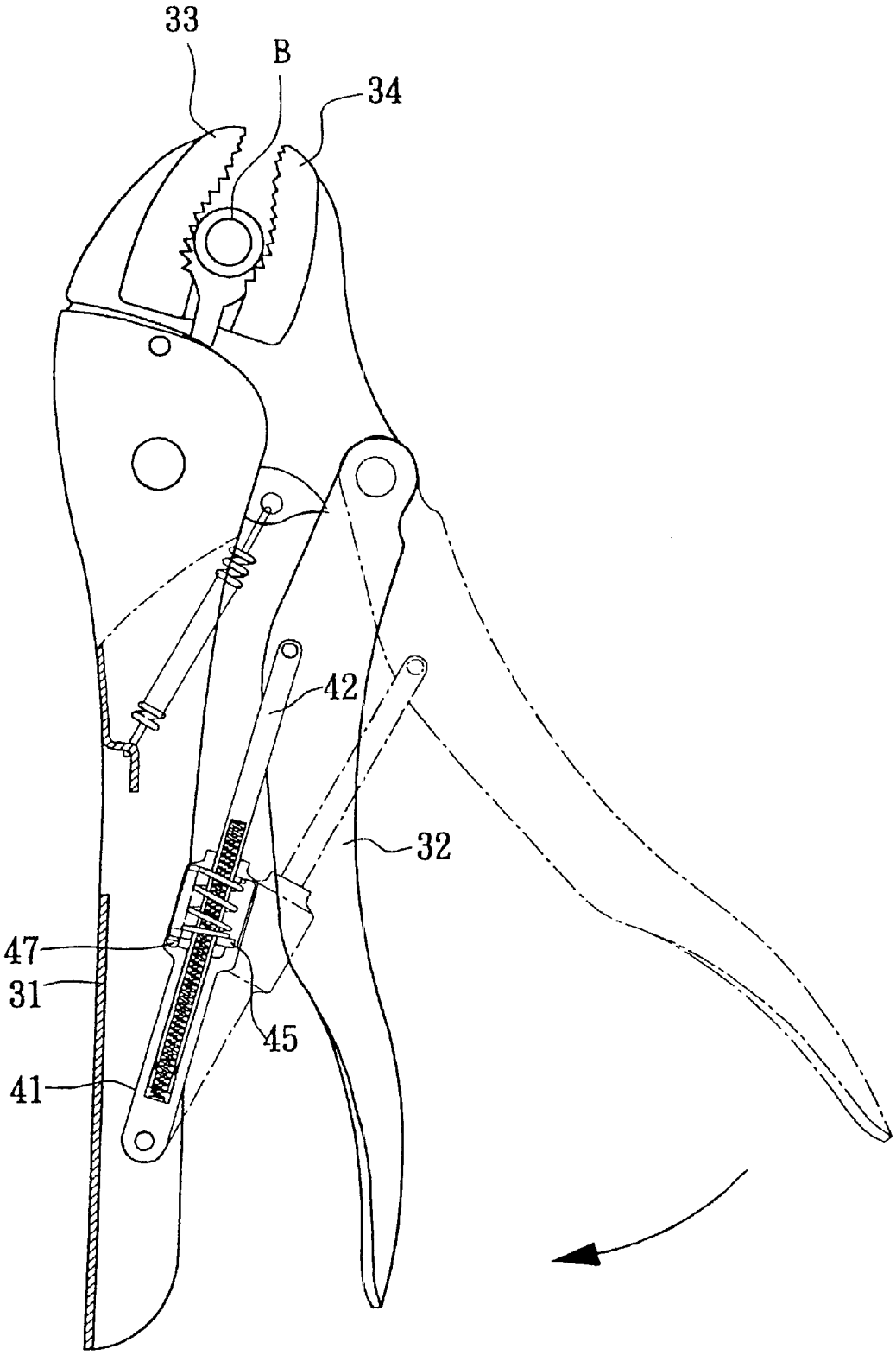
FIG. 10 shows a schematic view of the second preferred embodiment of the present invention at work.
Figure 11:
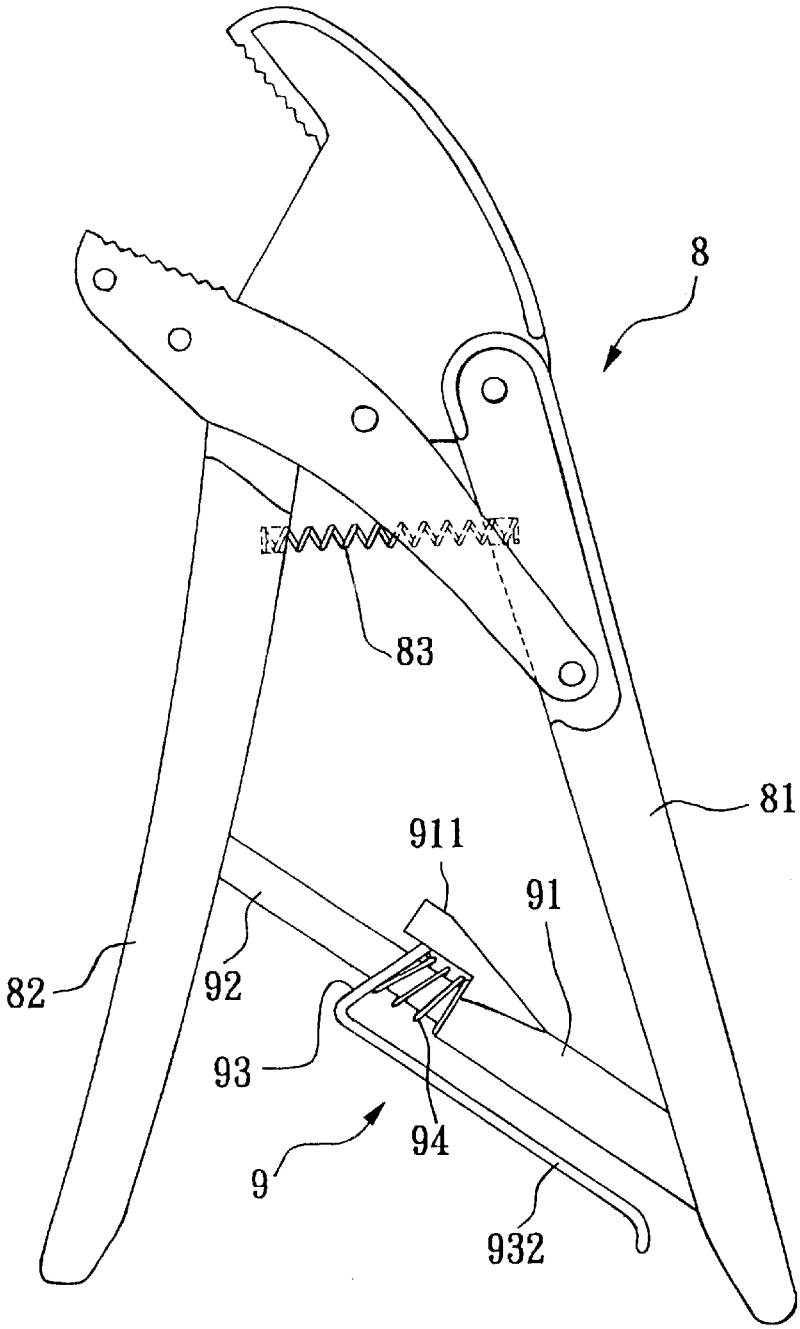
F I G . 1 1 PRIOR ART
FIG. 11 shows a perspective view of an arresting device of the prior art.
Figure 12:
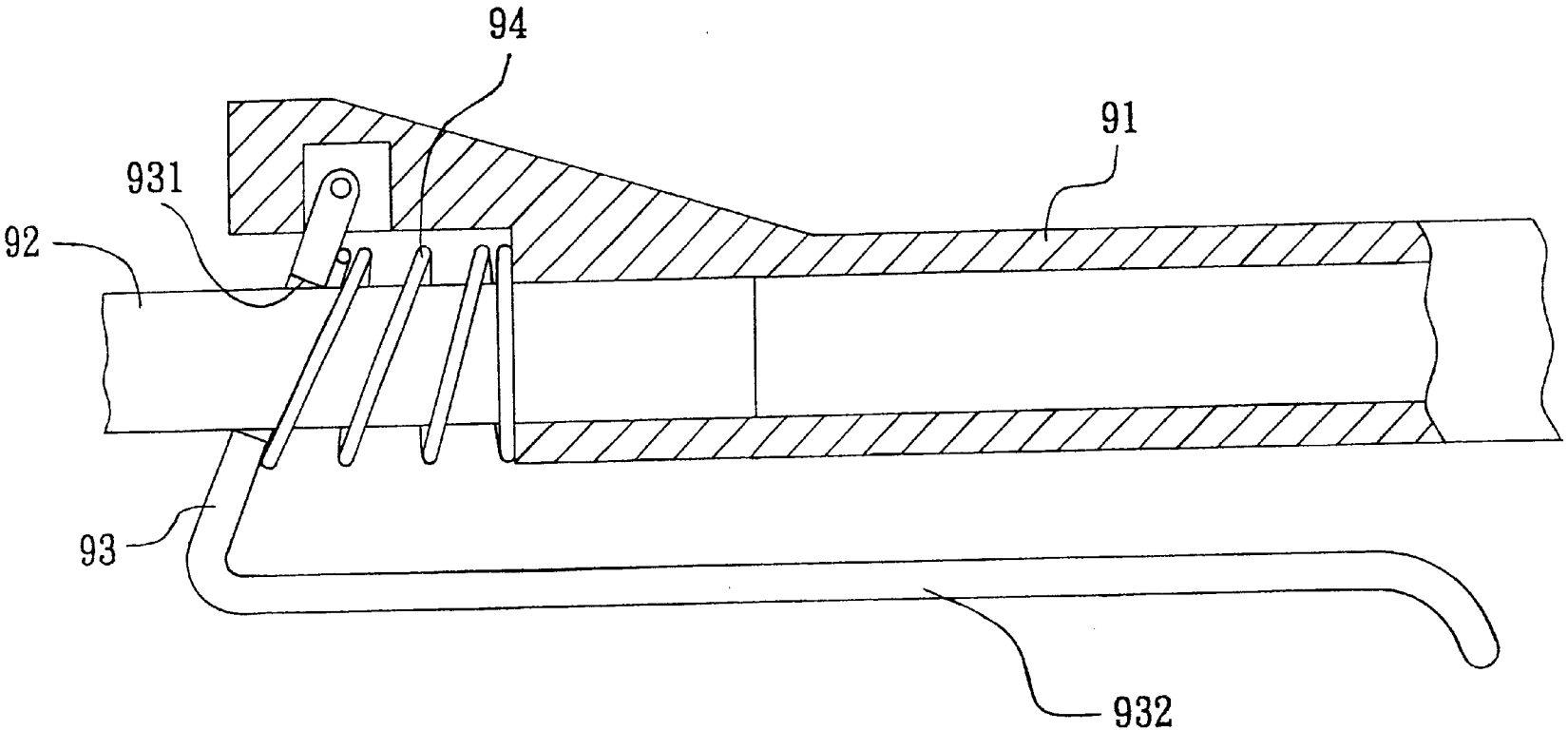
FIG. 12 PRIOR ART
FIG. 12 shows an enlarged sectional view of the prior art arresting device as shown in FIG. 11.

As shown in FIGS. 8–10, an arresting device 4 of the second preferred embodiment of the present invention is mounted between a first handle 31 and a second handle 32 of a pair of pliers 3. The arresting device 4 comprises a retaining piece 45 which is disposed in a receiving cell 44, and a spring 46 which is disposed between the retaining piece 45 and a side wall 442 of the receiving cell 44. When the movable end 451 of the retaining piece 45 is in the free state, the retaining piece 45 is in the free state, the retaining piece 45 is urged by the spring 46 to retain the rod 42, which is thus capable of moving outward only.

When the pliers 3 are used to hold a workpiece, the pin 47 is turned to push away the retaining piece 45 from the rod 42, as shown in FIG. 9. The rod 42 is thus allowed to move in two directions. When the two handles 31 and 32 are gripped securely, the rod 42 is actuated to move into the sleeve 41 so as to enable two jaws 33 and 34 of the pliers 3 to hold an object "B", as shown in FIG. 10. As the pin 47 is turned such that the recess 471 of the pin 47 is opposite to the retaining piece 45, and that the movable end 451 of the retaining piece 45 is in the free state. The retaining piece 45 is urged by the second spring 46 such that the rod 42 is slantingly retained by the through hole 452. As a result, the rod 42 can not be moved inwards, thereby locating the two handles 31 and 32 to hold the object "B". The object "B" can be let go by turning the pin 47 to push away the retaining piece 45, so as to enable the rod 42 to move in two directions. As a result, the two handles 31 and 32 can be moved away from each other to enable the jaws 33 and 34 to release the object "B".

The embodiments of the present invention described above are to be regarded in all respects as being merely illustrative and nonrestrictive. Accordingly, the present invention may be embodied in other specific forms without deviating from the spirit thereof. The present invention is therefore to be limited only by the scopes of the following claims.

What is claimed is:

1. A pair of pliers comprising two handles and an arresting device mounted pivotally between the two handles, said arresting device comprising a sleeve and a rod fitted into said sleeve, said sleeve and said rod being fastened pivotally at one end thereof with said handles, said sleeve having a receiving cell which is provided therein with a retaining piece pressing at one end thereof against a projection of said receiving cell, said retaining piece being provided with a movable end opposite to said one end of said retaining piece, sand retaining piece further having a through hole greater in diameter than said rod, said retaining piece and a side wall of said receiving cell being provided therebetween with a spring for urging said retaining piece so as to cause said movable end of said retaining piece to sway to enable said through hole of said retaining piece to retain slantingly said rod such that said rod can be moved only in one direction, said receiving cell being provided with a pin corresponding in location to said movable end of said retaining piece, said pin being turned to push away said retaining piece so as to enable said rod to move in two directions, said pin being turned such that a recess of said pin is corresponding to said retaining piece so as to enable said movable end of said retaining piece to be in a free state, thereby causing said retaining piece to be urged by said spring to retain said rod, so as to control unidirectionally a moving direction of said rod.

2. The pliers as defined in claim 1, wherein said sleeve of said arresting device is provided with an axial hole to receive said rod, said rod being provided at other end thereof with a receiving hole, a spring being disposed between said receiving hole and a bottom of said axial hole for urging said rod to extend through said axial hole.

3. The pliers as defined in claim 1, wherein said pin of said arresting device has a control lever such that said control lever is jutted out of said receiving cell.

4. The pliers as defined in claim 1, wherein said retaining piece of said arresting device is disposed in said receiving cell which is located at other end of said sleeve; further wherein said spring of said arresting device is disposed between said retaining piece and one side wall of said receiving cell, and said spring urges said retaining piece to retain said rod such that said rod can be moved inwardly only at such time when said movable end of said retaining piece is in the free state.

5. The pliers as defined in claim 1, wherein said retaining piece of said arresting device is disposed in said receiving cell which is located at other end of said sleeve; further wherein said spring of said arresting device is disposed between said retaining piece and other side wall of said receiving cell, and said spring urges said retaining piece to retain said rod such that said rod can be moved outwardly only at such time when said movable end of said retaining piece is in the free state.

* * * * *